United States Patent [19]

Akiyama et al.

[11] Patent Number: 4,637,781

[45] Date of Patent: Jan. 20, 1987

[54] TORQUE REGULATING SYSTEM FOR FLUID OPERATED PUMP DISPLACEMENT CONTROL SYSTEMS

[75] Inventors: Teruo Akiyama, Yokohama; Katsuyuki Sasaki, Kyoto; Takaichi Saigo, Chigasaki, all of Japan

[73] Assignee: Kabushiki Kaisha Komatsu Seisakusho, Tokyo, Japan

[21] Appl. No.: 717,197

[22] Filed: Mar. 28, 1985

[30] Foreign Application Priority Data

Mar. 30, 1984 [JP] Japan ..... 59-060841
Nov. 30, 1984 [JP] Japan ..... 59-251992

[51] Int. Cl.[4] ..... F04B 49/00

[52] U.S. Cl. ..... 417/216; 417/218; 417/222; 60/444; 60/449; 60/452

[58] Field of Search ..... 417/212, 213, 216, 218, 417/222, 34; 60/444, 449, 452

[56] References Cited

U.S. PATENT DOCUMENTS

| | | | |
|---|---|---|---|
| 3,875,849 | 4/1975 | Patel | 91/374 X |
| 3,891,354 | 6/1975 | Bosch | 417/216 |
| 3,935,706 | 2/1976 | Stevens | 417/218 X |
| 3,963,378 | 6/1976 | McMillan | 417/216 |
| 4,081,223 | 3/1978 | Fricke et al. | 417/218 |
| 4,158,290 | 6/1979 | Cornell | 60/449 X |
| 4,248,574 | 2/1981 | Uehara et al. | 417/216 |
| 4,274,257 | 6/1981 | Koch, Jr. et al. | 417/222 |
| 4,498,847 | 2/1985 | Akiyama | 417/222 X |

FOREIGN PATENT DOCUMENTS

| | | | |
|---|---|---|---|
| 2363480 | 6/1975 | Fed. Rep. of Germany | 417/221 |
| 159580 | 12/1981 | Japan | 417/212 |

*Primary Examiner*—Louis J. Casaregola
*Assistant Examiner*—Paul F. Neils
*Attorney, Agent, or Firm*—Armstrong, Nikaido, Marmelstein & Kubovcik

[57] ABSTRACT

A fluid operated pump displacement control system is provided wherein a self pressure is defined as a first control signal, and characterized in that an arbitrary switchable second control signal different from the first control signal is added to the first control signal, and a displacement is adapted to be switched to a displacement corresponding to a value of the second control signal as added to the first control signal. Further, a fluid operated pump displacement control system is provided comprising a control circuit connected to respective displacement control devices of variable displacement pumps and adapted to be operated by discharge pressure fluid from a discrete control pump. A variable torque control valve has a proportional electromagnetic solenoid provided in a circuit connecting the control circuit with the control pump and is adapted to produce a pressure reduction by a discharge fluid pressure of the variable displacement pumps and a propelling force of the proportional electromagnetic solenoid. A detector detects set output conditions of a prime mover for driving the variable displacement pumps, and current is supplied to the proportional electromagnetic solenoid according to the difference between a set reference rotational speed in each of the set output conditions and an actual rotational speed of the prime mover.

2 Claims, 8 Drawing Figures

TORQUE REGULATING SYSTEM FOR FLUID OPERATED PUMP DISPLACEMENT CONTROL SYSTEMS

BACKGROUND OF THE INVENTION (1) Field of the Invention

This invention pertains to a fluid operated control system for a variable displacement pump or pumps driven by a prime mover such as an internal combustion engine. More particularly, the invention is directed to a system for controlling the per cycle displacement of a variable displacement pump or pumps supplying fluid under pressure to implements actuators in which the torque requirement of the pump or pumps can be varied without changing the setting output condition of the prime mover.

(2) Description of the Prior Art

In a conventional control of a variable displacement pump (which will be hereinafter referred simply to as a variable pump), a device for controlling displacement of the variable pump is known for example, wherein a discharge oil of a control hydraulic pump is supplied through a control valve to a servo cylinder for changing a swash plate angle of the variable pump, and a pressure reducing operation of the control valve is controlled according to a discharge pressure of the variable pump, thus controlling displacement of the variable pump according to the discharge pressure thereof and maintaining a torque requirement or torque demand of the variable pump (displacement per cycle of pump x pressure) constant. Namely, a control device defining a self pressure as a control signal is known.

In such a control device as above, because the torque requirement of the variable pump is constant, it is common that the torque requirement is set to a torque requirement corresponding to a rated point under a maximum set output condition (full load) of an engine for purpose of effective utilization of engine horse power, and the torque requirement of the variable pump is dependent upon set output conditions of the engine, that is, lever positions of a fuel injection pump of the engine.

Further, when the set output condition of the engine is set to a partial load, that is, the lever position of the fuel injection pump is set to a low speed side to reduce a set output, a rotational speed of the engine is reduced, but the torque requirement of the variable pump is not temporarily changed. However, as a rotational speed of the variable pump is reduced, the torque requirement of the variable pump is resultantly reduced to decrease displacement per unit time of the variable pump. Therefore, an operating speed of implement actuators is reduced. For example, in a constructional machine such as a power shovel, when loading work of light-weight materials and ground levelling work are carried out, it is necessary to quickly operate implements with no need for large power. In such light work as above, if the engine is driven at low speeds, displacement per unit time of the variable pump is reduced as mentioned above, resulting in reduction in operating speed of the implement actuators and reduction in working efficiency. On the other hand, in such a partial loaded condition of a set engine output as above, a maximum torque of the engine is rendered lower than a rated torque under full load, and accordingly the torque of the engine is rendered lower than the torque requirement of the variable pump, resulting in the possibility of engine stall.

Accordingly, in the case that the engine is driven where air density is small or a crude fuel is used as engine fuel, the engine output corresponding to the lever position may not be obtained. Therefore the torque corresponding to the rated torque may not be obtained in spite of setting of the engine under full load. As a result, the torque requirement of the variable pump with respect to an effective torque of the engine is enlarged to disadvantageously decrease the engine rotational speed, and in the worst case, to stop the engine. To avoid these disadvantages, when the engine is set at a full loaded rotational speed so as to sufficiently secure displacement per unit time of the variable pump, fuel consumption of the engine is uneconomically increased instead.

SUMMARY OF THE INVENTION

Accordingly, it is an object of the present invention to provide a fluid operated pump displacement control system which may change a torque requirement of the variable pump according to the difference between each of a set of reference output rotational speeds in engine set output conditions and an actual rotational speed of the engine.

It is another object of the present invention to provide a fluid operated pump displacement control system which may change a torque requirement of the variable pump without varying set output conditions of the engine by defining a self pressure as a first control signal, arbitrarily selecting a second control signal to be added to the first control signal, and controlling the torque requirement to a capacity corresponding to the second control signal, that is, the torque requirement of the variable pump.

It is a further object of the present invention to provide a fluid operated pump displacement control system which may set a torque requirement of the variable pump corresponding to applications of the implements (content of work), and improve working efficiency and simultaneously suppress fuel consumption of the engine.

To achieve the above-mentioned objects, there is provided according to the present invention a fluid operated pump displacement control system wherein a self pressure is defined as a first control signal, and characterized in that an arbitrary switchable second control signal different from the first control signal is added to the first control signal, and a displacement is adapted to be switched to a displacement corresponding to a value of the second control signal as added to the first control signal.

According to the present invention, there is further provided a fluid operated pump displacement control system comprising a control means connected to respective displacement control devices of variable displacement pumps and adapted to be operated by discharge pressure fluid from a discrete control pump, a variable torque control valve having a proportional electromagnetic solenoid provided in a circuit connecting the control means with the control pump and adapted to operate pressure reduction by a discharge fluid pressure of the variable displacement pumps and a propelling force of the proportional electromagnetic solenoid, means for detecting set output conditions of a prime mover for driving the variable displacement pumps, and means for supplying current to the proportional electromagnetic solenoid according to the difference between a set reference rotational speed in each of the set output conditions and an actual rotational speed of the prime mover.

The above and many other advantages, features and additional objects of the present invention will become manifest to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENT

Figure 1:
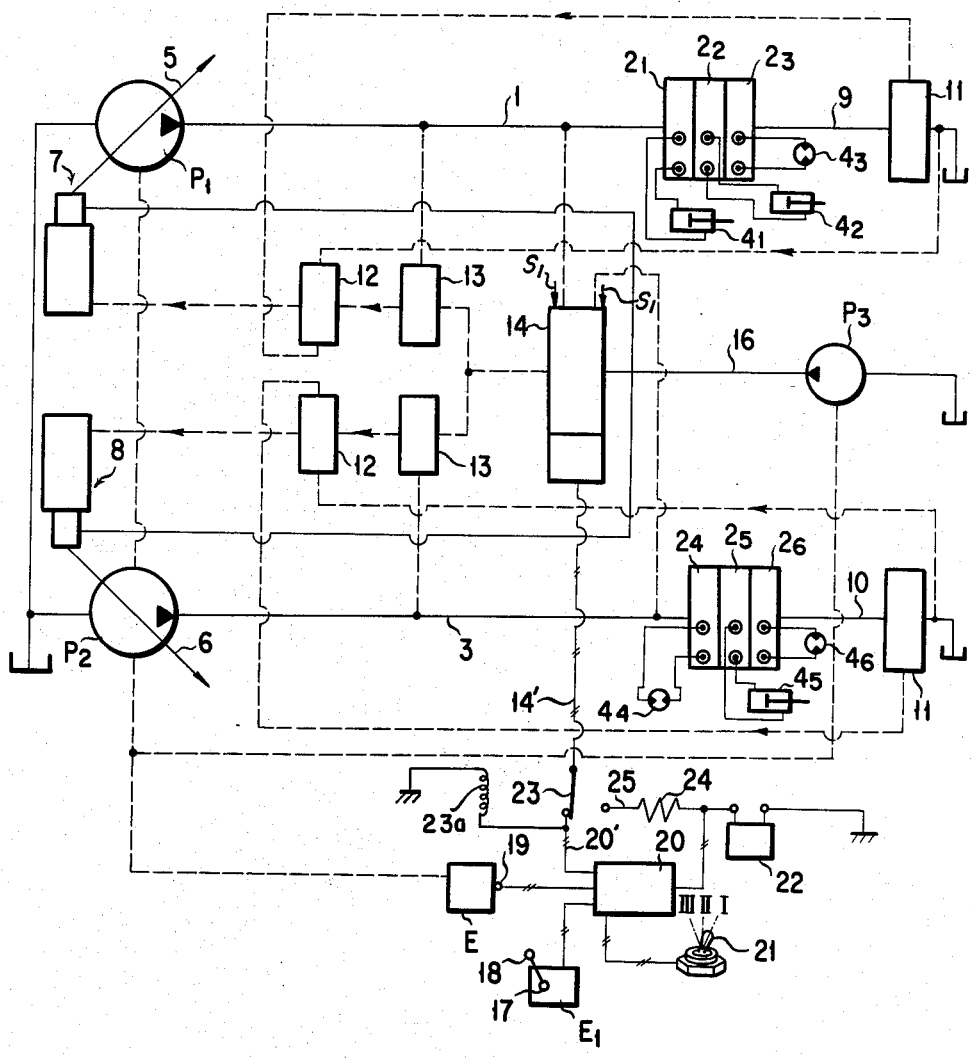
FIG. 1 is a schematic diagrammatic view showing a general constitution of a preferred embodiment according to the present invention.

Referring to FIG. 1 which shows a general circuit diagram, first and second variable displacement hydraulic pumps (which will be hereinafter referred to as first and second variable pumps) $P_1$ and $P_2$ and a fixed displacement hydraulic control pump (which will be hereinafter referred to as a control pump) $P_3$ of a small capacity are driven by an engine E. First, second and third operating valves $2_1$, $2_2$ and $2_3$ are connected in parallel to a discharge passage 1 of the first variable pump $P_1$, and fourth, fifth and sixth operating valves $2_4$, $2_5$ and $2_6$ are connected in parallel to a discharge passage 3 of the second variable pump $P_2$. Each of the operating valves $2_1$ to $2_6$ is a known three position selector valve for supplying a discharge oil to first to sixth actuators $4_1$ to $4_6$ for a motor and a cylinder, etc.

Displacement control members (which will be hereinafter referred to as swash plates) 5 and 6 of the first and second variable pumps $P_1$ and $P_2$ are controlled by control mechanisms 7 and 8, and the control mechanisms 7 and 8 are controlled by a discharge oil from the control pump $P_3$. There are provided in a discharge passage 16, neutral control valves (which will be hereinafter referred to as NC valves) 12, cut-off valves (which will be hereinafter referred to as CO valves) 13 and a variable torque control valve 14 which are adapted to be operated by jet sensor 11 provided in drain passages 9 and 10 leading from the discharge passages 1 and 3 of the first and second variable pumps $P_1$ and $P_2$.

Reference numeral 17 designates a potentiometer for detecting a position of a control lever 18 of a fuel injection pump $E_1$ of the engine E, while reference numeral 19 designates a speed sensor for detecting an actual rotational speed of the engine E. Respective detection values (signal voltages) are fed to a controller 20 which in turn outputs a signal current to the variable torque control valve 14.

Reference numerals 21, 22 and 23 designate a mode selector switch, power supply and selector switch. The selector switch 23 normally connects an output circuit 20' of the controller 20 with a circuit 14' to the variable torque control valve 14, and when the controller 20, etc. malfunctions, the selector switch 23 acts to connect the circuit 14' with a redundant circuit 25 having a resistor 24 connected to a battery 22.

The mode selector switch 21 is manually selected to an ordinary mode position I, medium mode position II and low mode position III to output a control signal to the controller 20.

Figure 2:
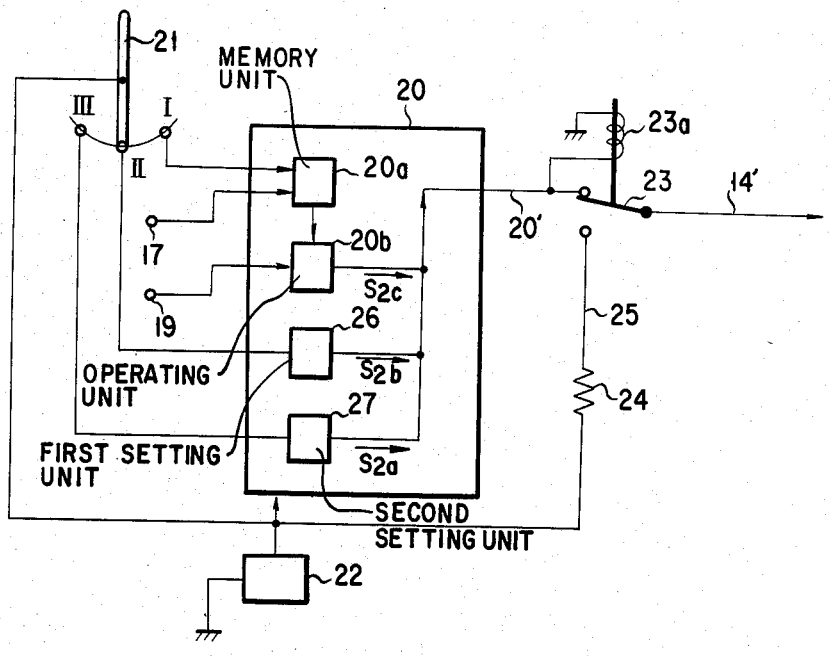
FIG. 2 is a circuit diagram of a controller to be used in the preferred embodiment.

In other words, as shown in FIG. 2, when the mode selector switch 21 is selected to the ordinary mode position I, a set output condition of the engine (e.g., maximum output condition, medium output condition and low output condition) is detected according to a position of the control lever 18 as detected by the potentiometer 17, and a detection value as obtained above is inputted to a memory unit **20*a* FIG. 2, of the controller 20, where a set reference rotational speed $N_{set}$ in the set output condition is read from the memory unit 20*a* to be inputted to an operating unit 20*b*. Simultaneously, an actual rotational speed N detected by the speed sensor 19 is inputted to the operating unit 20*b*. When the actual rotational speed N becomes lower than the set reference rotational speed $N_{set}$, current is supplied to the circuit 14' of the variable torque control valve 14 according to a value of $(N_{set}-N)$. Japanese Patent Application Laid-Open No. 58-210383 shows a controller similar to the one shown in FIG. 2**.

When the mode selector switch 21 is selected to the medium mode position II, current as set by a first setting unit 26 of the controller 20 is supplied to the output circuit 20'. On the other hand, when the mode selector switch 21 is selected to the low mode position III, current as set by a second setting unit 27 is supplied to the output circuit 20', where the position of the control lever 18 and the actual rotational speed N are no longer required.

The variable torque control valve 14 serves as varying a discharge pressure of the control pump $P_3$ according to the discharge pressures of the first and second varible pumps $P_1$ and $P_2$, that is, a first control signal $S_1$ and an arbitrary suitable second control signal $S_{2a}$, $S_{2b}$, or $S_{2c}$ to be fed from the controller 20. The control mechanisms 7 and 8 act to change angles of the swash plates 5 and 6 to increase or decrease per cycle displacements of the first and second variable pumps $P_1$ and $P_2$, thereby changing a torque requirement.

In this manner, when the mode selector switch 21 is selected to the low mode position III, an output pressure of the variable torque control valve 14 is controlled according to the set current as set by the second setting unit 27, that is, a second control signal $S_{2a}$ irrespective of a set output condition and an actual rotational speed of the engine, thereby determining the torque requirement. The set current as set by the second setting unit 27 is a value corresponding to a torque requirement suitable for a light work, and the torque requirement in this case is shown by X in FIG. 8, where an engine speed is increased with respect to a torque requirement Y as determined to a rated point under full load, and accordingly the displacement per unit time of the first and second variable pumps $P_1$ and $P_2$ is increased, while the discharge pressure is decreased, thereby reducing fuel consumption of the engine and rendering the torque requirement suitable for the light work under low pressure at high speed.

Similarly, when the mode selector switch 21 is selected to the medium mode position II, an output pressure of the variable torque control valve 14 is controlled according to the set current as set by the first setting unit 26, that is, a different second control $S_{2b}$ signal, thereby determining a torque requirement. The set current as set by the first setting unit 26 is a value corresponding to a torque requirement suitable for normal work, and the torque requirement in this case is shown by Z in FIG. 8, where it is in an intermediate position between the torque requirements Y and X, thereby resulting in an intermediate pressure and an intermediate displacement per unit time which are suitable for normal work.

Further, when the mode selector switch 21 is selected to the normal mode position I, an output pressure of the varible torque control vave 14 is controlled according to the set current as set by the operating unit **20*b* of the controller 20, that is, a further different second control signal $S_{2c}$, thereby determining a torque requirement. The set current as set by operating unit 20*b* is a value corresponding to a torque requirement suitable for heavy work as shown by Y in FIG. 8**, thereby resulting in a high pressure and a small displacement per unit time which are suitable for the heavy work.

Upon selection of the ordinary mode position I in the preferred embodiment, since the output current is controlled according to a set output condition and an actual rotational speed of the engine, it is possible to obtain a torque requirement corresponding to an effective torque of the engine. Even when an engine output corresponding to the set output condition of the engine may not be obtained in such a case that the engine is operated at a high altitude where the density of the atmosphere is small and a crude fuel is used as engine fuel, there is no possibility that the torque requirement is increased with respect to the effective torque of the engine to decrease an engine rotational speed, and in the worst case, to cause an engine stall.

In this manner, the torque requirement may be controlled to a value corresponding to each work condition by simply selecting the mode selector switch 21 to add a different arbitrary second control signal to a first control signal, thus permitting various works to be efficiently carried out without increasing fuel consumption of the engine.

Figure 3:
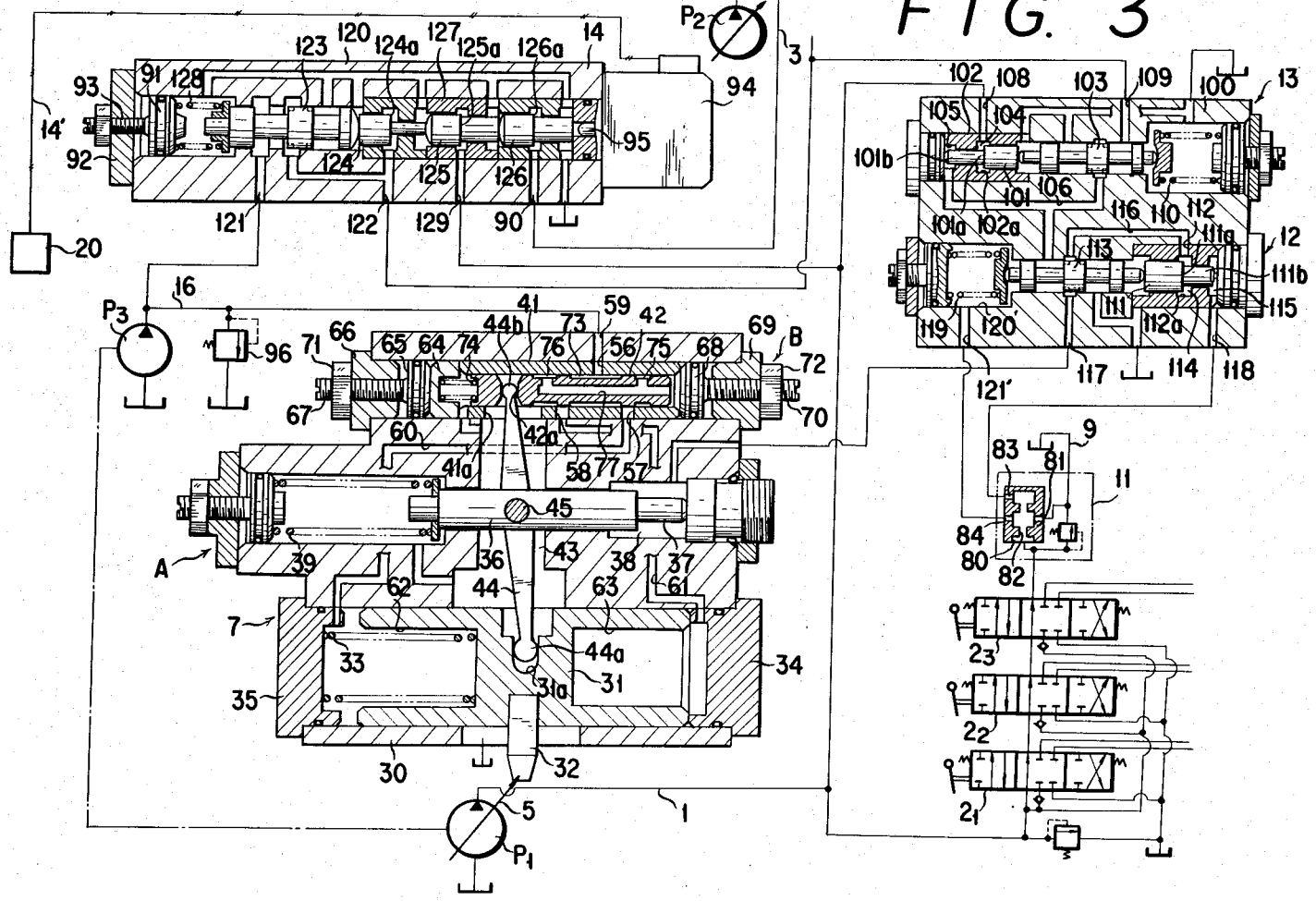
FIG. 3 is a detailed sectional view of the essential part of the preferred embodiment.

Referring to FIG. 3 which shows a detailed sectional view of each member on the first variable pump $P_1$ side, the control device 7 includes a servo piston 31, input signal section A and guide valve section B in a casing 30. The servo piston 31 is connected through a rod 32 to a swash plate 5, and is normally retained in a minimum swash angle position (minimum displacement position) as shown in the drawing by a pair of springs 33 which are held by end covers 34 and 35.

The input signal section A is provided with a control piston 36 having a projecting rod 37 on one side thereof to define a first chamber 38, and there is linearly provided a spring 39 on the other side of the control piston 36.

The guide valve section B comprises a guide spool 42 inserted in a sleeve 41, and the casing 20 is formed with a cut-away portion 43 opening through the sleeve 41, the control piston 36 and the servo piston 31. An arm 44 is provided in the cut-away portion 43, and is pivotably supported by a pin 45 to the control piston 36 at a central portion thereof. One end **44*a* of the arm 44 is engaged with a recess 31*a* of the servo piston 31, while the other end 44*b* is engaged with a recess 42*a* of the guide spool 42 through a bore 41*a* of the sleeve 41**.

The sleeve 41 is formed with an inlet port 56 and first and second outlet ports 57 and 58. The inlet port 56 opens to an inlet hole 59, and the first and second outlet ports 57 and 58 are communicated through first and second passages 60 and 61 formed in the casing 30 with first and second pressure chambers 62 and 63 of the servo piston 31, respectively. One end surface of the sleeve 41 abuts through a spring seat 64 and a free piston 65 against an adjusting plug 67 threadedly engaged with a cap 66, while the other end surface abuts through a free piston 68 against an adjusting plug 70 threadedly engaged with a cap 69. Reference numerals 71 and 72 designate lock nuts.

The guide spool 42 is formed with an annular recess 73 blockably communicating the inlet port 56 with the first and second outlet ports 57 and 58, and is normally urged rightwardly by a spring 74 to retain the servo piston 31 in the minimum swash angle position. Further, the guide spool 42 is formed with first and second annular recesses 75 and 76 blockably communicating the first and second outlet ports 57 and 58 with the cut-away portion 43 and is formed with a shaft hole 77.

The CO valve 13 and the NC valve 12 are formed integrally with each other.

The cut-off valve 13 is constituted in the following manner. That is, a valve body 100 is provided with a sleeve 102 incorporating a piston 101 and with a spool 103 which are linearly arranged. A first pressure receiving chamber 104 is defined by a shoulder **101*a* of the piston 101 and a hole 102*a* of the sleeve 102. A small diametrical portion 101*b* of the piston 101 is exposed to a second pressure receiving chamber 105 at a free end thereof, and the second pressure receiving chamber 105 is blockably communicated through a passage 106 with a port 109 by the spool 103. The first pressure receiving chamber 104 is connected through a port 108 to the discharge passage 1. The spool 103 is leftwardly biased by a spring 110 to blockably communicate the passage 106 with a port 109**.

On the other hand, the neutral control valve 12 is constituted in the following manner. That is, the valve body 100 is provided with a sleeve 112 incorporating a piston 111 and with a spool 113 which are linearly arranged. A third pressure receiving chamber 114 is defined by a shoulder **111*a* of the piston 111 and a hole 112*a* of the sleeve 112. A small diametrical portion 111*b* of the piston 111 is exposed to a fourth pressure receiving chamber 115. The third pressure receiving chamber 114 is communicated through a passage 116 with a port 117 which is in turn blockably communicated with the passage 106 by the spool 113. The fourth pressure receiving chamber 115 opens to a port 118. The spool 113 is rightwardly biased by a spring 119, and a spring chamber 120' opens to a port 121'**.

The jet sensor 11 is provided with a restriction 82 between an inlet port 80 and an outlet port 81, and is designed to detect a total pressure (static pressure+dynamic pressure) at a first port 83 and a static pressure at a second port 84. The first port 83 is communicated through the port 118 with the fourth pressure receiving chamber 115, while the second port 84 is communicated through the port 121' with the spring chamber 120'. The port 117 is communicated with the first chamber 38.

The variable torque control valve 14 includes in a valve body 120 a spool 123 blockably communicating an inlet port 121 with an outlet port 122 and a sleeve 127 incorporating first, second and third pistons 124, 125 and 126 which are linearly arranged. The spool 123 is biased by a spring 128 in such a direction as to communicate the inlet port 121 with the outlet port 122, and commnicate a pressure receiving portion 124*a* of the first piston 124 with the outlet port 122, thus forming a pressure reducing valve. A pressure receiving portion 125*a* of the second piston 125 is connected through a port 129 to the discharge passage 1 to leftwardly urge the spool 123 by the second piston 125 against the spring 128. A pressure receiving portion 126*a* of the third piston 126 is connected through a port 90 to the discharge passage 3 of the second variable pump $P_2$. An adjusting bolt 93 threadedly engaged with an end cover 92 is provided in opposed relation with a spring seat 91 of the spring 128. An output plunger 95 of a proportional electromagnetic solenoid 94 is provided in opposed relation with an end surface of the third piston 126. The input port 121 is connected to the discharge passage 16 of the control pump $P_3$, while the outlet port 122 is connected to the port 109 of the cut-off valve 13.

In operation, when the first to third operating valves $2_1$ to $2_3$ are in a neutral position, a flow rate in the drain passage 9 is large, and pressure differential between the total pressure and the static pressure of the jet sensor 11 becomes maximum, while pressure differential between the total pressure supplied to the fourth pressure receiving chamber 115 of the neutral control valve 12 and the static pressure supplied to the spring chamber 120' becomes maximum. Accordingly, a biasing force of the spring 119 leftwardly biasing the spool 113 is rendered maximum. At the same time, the pressure at the port 117 is supplied to the third pressure receiving chamber 114 to leftwardly urge the spool 113 against the spring 119, thus rendering an output pressure of the neutral control valve 12 (output pressure from the port 117) minimum.

At this time, as the pressure in the discharge passage 1 is minimum, the pressure at the pressure receiving portion 125*a* of the variable torque control valve 14 becomes minimum to minimize a pushing force of the second piston 125 against the spool 123. Accordingly, the spool 123 is rightwardly biased by a spring 128 to communicate the inlet port 121 with the outlet port 122 and allow an original pressure set by a relief valve 96 of the control pump $P_3$ to be discharged from the outlet port 122 and be supplied to the port 106 of the cut-off valve 13.

As the pressure supplied to the first pressure receiving portion 104 of the cut-off valve 13 is also minimum, a rightward pushing force of the piston 101 is rendered minimum, and accordingly the spool 103 is leftwardly biased by the spring 110 to communicate the port 109 with the passage 106 and supply the original pressure of the control pump $P_3$ through the passage 106 to the neutral control valve 12.

However, since the output pressure of the neutral control valve 12 is designed to be minimum as mentioned above, the original pressure of the control pump $P_3$ is reduced to its minimum discharge pressure, and is supplied as a control pressure through the port 117 to the first chamber 38 of the input signal section A.

As the control pressure as mentioned above is minimum, the control piston 36 is rightwardly biased by the spring 39 to allow the projecting rod 37 to abut against the plug as shown in the drawing. In such a position of the servo piston 31 as shown in the drawing, the swash plate 5 is set to a minimum swash angle position to minimize a per cycle displacement of the first variable pump $P_1$.

In other words, the sleeve 41 is set to the position shown in the drawing to block communication between the inlet port 56 and the first and second outlet ports 57 and 58, thereby balancing pressures in the first and second pressure chambers 62 and 63 of the servo piston 31.

When the first operating valve $2_1$ is selected to supply a part of the discharged oil from the first variable pump $P_1$ to a first actuator $4_1$, a flow rate in the drain passage 9 is reduced to decrease detection pressure differential of the jet sensor 11, and accordingly pressure differential between the pressure in the spring chamber 120' and the pressure in the fourth pressure chamber 115 of the neutral control valve 12 is reduced. As a result, a rightward pushing force against the spool 113 is enlarged to increase the pressure at the port 117. Accordingly, the pressure in the first chamber 38 is increased to leftwardly urge the control piston 36 and leftwardly rock the arm 44 as a fulcrum of the servo piston 31 to leftwardly move the guide spool 42, thereby permitting the inlet port 56 to be communicated with the second outlet port 58. As a result, the discharge oil from the control pump $P_3$ is supplied to the second pressure chamber 63 of the servo piston 31 to move the servo piston 31 leftwardly and thereby to increase the swash angle of the swash plate 5 and increase the per cycle displacement of the first variable pump $P_1$.

As a result, the arm 44 is rocked clockwise about the pin 45 of the control piston 36, and the guide spool 42 is rightwardly urged by the end 44*b* of the arm 44 to block communication between the inlet port 56 and the second outlet port 58, thus increasing the displacement of the first variable pump $P_1$ by the amount of reduction in the detection pressure differential of the jet sensor 11.

Namely, movement of the servo piston 31 is fed back through the arm 44 to the guide spool 42.

At this time, since the control piston 36 is leftwardly moved according to spring characteristics of the spring 39, increase in the per cycle displacement of the first variable pump $P_1$ may be arbitrarily modified according to the spring charactristics.

Further, when the pressure in the discharge passage 1 is increased, the pressure at the pressure receiving portion 125*a* of the variable torque control valve 14 is increased to increase a pushing force of the second piston 125. Accordingly, the spool 123 is strongly urged leftwardly against the spring 128 to enhance a pressure reducing effect, resulting in reduction in the output pressure at the outlet port 122.

As a result, a control pressure to be supplied through the cut-off valve 13 and the neutral control valve 12 to the first chamber 38 of the input signal section A is reduced, and the control piston 36 is rightwardly moved in opposition to the above case to reduce the per cycle displacement of the first variable pump $P_1$.

When the pressure in the discharge passage 1 is increased near a set pressure of the main relief valve, the pressure in the first pressure receiving chamber 104 of the cut-off valve 13 is enlarged and accordingly the spool 103 is rightwardly urged against the spring 110 by the piston 101 to block communication between the port 109 and the passage 106 and start a pressure reducing operation, thereby reducing an output pressure from the neutral control valve 12.

Subsequently, when the pressure in the discharge passage 1 is further increased, the pressure reducing operation is further carried out to minimize the output pressure from the neutral control valve 12. As a result, the control pressure in the first chamber 38 of the input signal section A is minimized, and accordingly the per cycle displacement of the first variable pump $P_1$ is also minimized, while a discharge pressure only is increased to the relief set pressure of the circuit and is retained at the pressure. Summarizing the above-mentioned operation, the variable control valve 14 functions to control the output pressure in such a manner as to decrease the per cycle displacement when the discharge pressure of the first and second variable pumps $P_1$ and $P_2$ is increased, and increase the same when the discharge pressure is decreased.

The above-mentioned operation is adapted to such a condition where a control current from the controller 20 is not supplied. There will be hereinafter described the case where the control current from the controller 20 is supplied.

Figure 4:
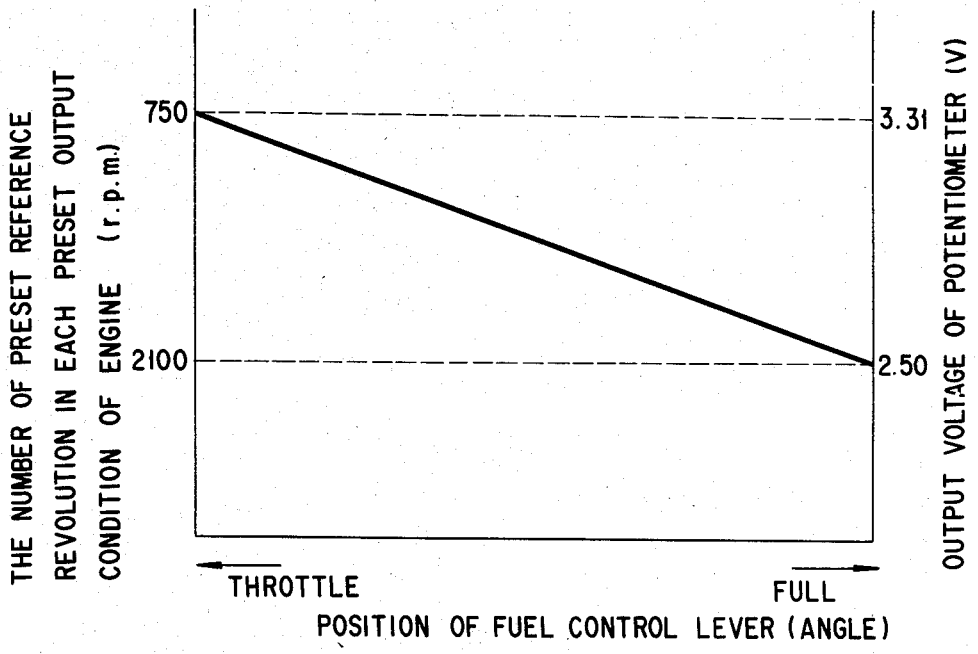
FIG. 4 is a graph showing relation among a control lever position, potentiometer output voltage and set reference rotational speed of the prime mover.

An output voltage of the potentiometer 17 is minimum at a full position (full load) as shown in FIG. 4, and is gradually increased toward slow position (partial load). Accordingly, it is possible to detect a set reference rotational speed of the engine stored in the memory unit 20*a*, that is, a set output condition of the engine, e.g., full load or partial load.

Figure 5:
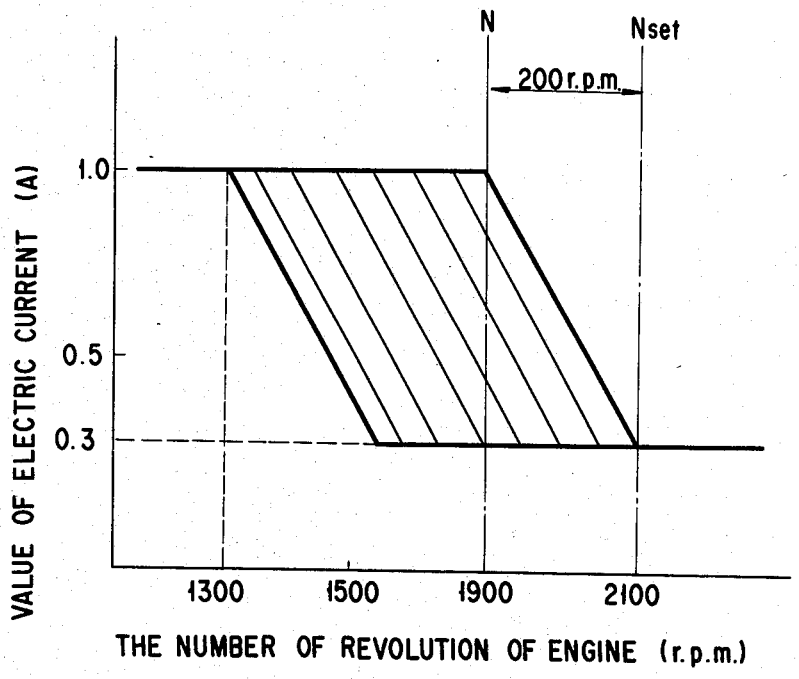
FIG. 5 is a graph showing relation between a rotational speed of the prime mover and a current value.

Then, the set reference rotational speed $N_{set}$ is inputted to the operating unit 20*b* of the controller 20, and is compared with an actual rotational speed N detected by the speed sensor 19. As a result, an output current to the output circuit 20' is controlled according to a value of $(N_{set}-N)$ as shown in FIG. 5.

Concretely, when the actual rotational speed N is lower by the amount of 200 rpm than the set reference rotational speed $N_{set}$, the output current is controlled according to the value of $(N_{set}-N)$. In the case that the set reference rotational speed $N_{set}$ is not more than 1500 rpm, a maximum output current is supplied.

Figure 6:
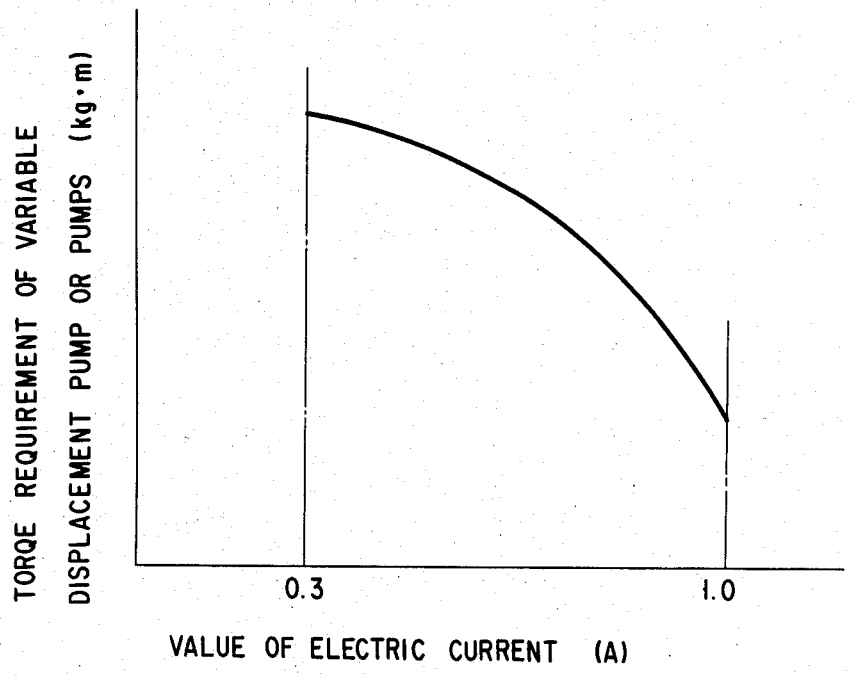
FIG. 6 is a graph showing relation between a current value and a torque requirement of the variable displacement pump.

On the other hand, when a current value to be supplied to the proportional electromagnetic solenoid of the variable torque control valve 14 is increased, a pushing force applied to the spool 123 is enlarged to decrease a discharge pressure at the outlet port 122. Conversely, the current value is decreased, the pushing force is reduced to increase the discharge pressure at the outlet port 122. In other words, when the current supply is increased, the per cycle displacement of the variable pump is decreased, while when decreased, the per cycle displacement is increased. Accordingly, relation between the torque requirement and the current value is such that the torque requirement is decreased with increase in the current value, while the former is increased with decrease in the latter as shown in FIG. 6.

Figure 7:
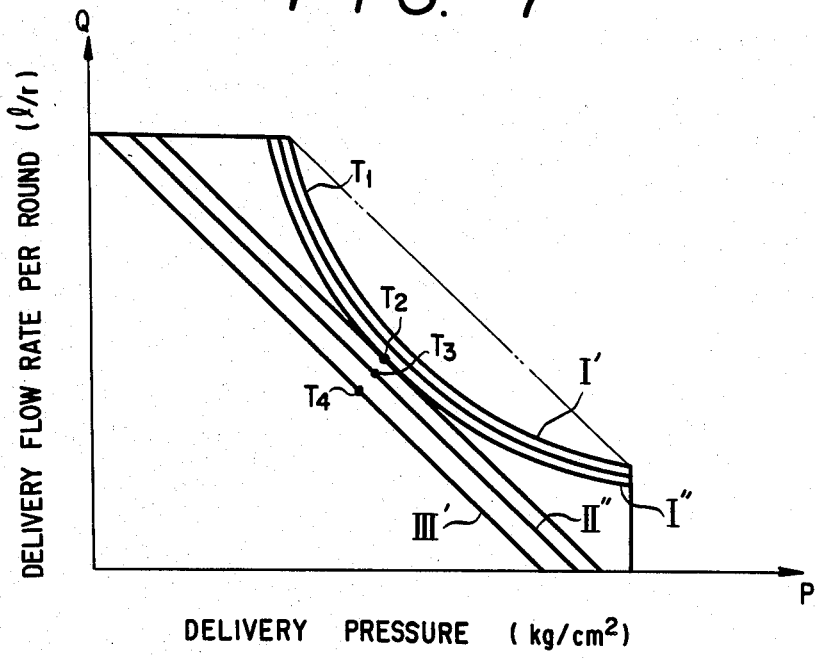
FIG. 7 is a graph showing relation between a pressure and a per cycle displacement of the variable displacement pump.

As a result, relation between the per cycle displacement of the variable pump and the pressure is varied according to a set reference rotational speed in the range of I' to II' as shown in FIG. 7, but is always constant in a certain set reference rotational speed.

As is above described, the torque requirement is changed according to a position of the control lever 18, that is, a set output condition of the engine to increase and decrease a per cycle displacement of the variable pump according to its discharge pressure and provide a torque requirement corresponding to the set output condition. Accordingly, even when the set output condition of the engine is under partial load as well as full load, it is possible to control a displacement of the variable pump without occurence of engine stall.

Concretely, when the control lever 18 is in its full position, that is, an engine rotational speed is not less than the rated point (set reference rotational speed $N_{set}$) of 2100 rpm under full load, current to be supplied to the proportional electromagnetic solenoid 94 is minimum (0.3 A). Until a torque requirement reaches the rated output of the engine, a per cycle displacement (swash plate angle) is maximum. When the engine rotational speed becomes lower than the rated point, the current to be supplied to the proportional electromagnetic solenoid 94 is increased according to $(N_{set}-N)$ to decrease the per cycle displacement. When the engine rotational speed becomes lower than 1900 rpm, the current to be supplied is rendered maximum to minimize the per cycle displacement, and thereby minimize the torque requirement.

Although, in the preferred embodiment, the torque requirement is controlled in the same manner as above under the condition where the engine set reference rotational speed $N_{set}$ is higher than 1500 rpm, while it is controlled so as to maximize the supply current value without occurence of engine stall and thereby minimize the per cycle displacement, it may be controlled in the same manner as above even when the value of $N_{set}$ is in the range of not more than 1500 rpm.

Further, as current set by the first setting unit 26 is supplied from the controller 20 to the proportional electromagnetic solenoid 94 under the condition where the mode selector switch 21 is in the medium mode position II, and a pushing force applied to the spool 123 becomes a predetermined value, a torque requirement may be rendered corresponding to the supply current value irrespective of the set output condition of the engine.

Similarly, as current by the second setting unit 27 is supplied from the controller 20 to the proportional electromagnetic solenoid 94 under the condition where the mode selector switch 21 is in the low mode position III, a torque requirement may be rendered corresponding to the supply current value irrespective of the set output condition of the engine.

In this manner, since the torque requirement may be arbitrarily set irrespective of the set output condition of the engine by selecting the mode selector switch 21, it is possible to effectively utilize an engine output suitable for operation of the actuator 2, that is, content of work, and improve fuel consumption.

In the event that the controller 20 is troubled for some reason, current is not supplied to the coil 23*a* of the selector switch 23, and accordingly the selector switch 23 is switched to connect the redundant circuit 25 with the circuit 14'. As a result, a set current is supplied from the redundant circuit 25 to the proportional electromagnetic solenoid 94, thus providing a predetermined torque requirement irrespective of the set output condition of the engine and controlling the per cycle displacement of the variable pump.

Figure 8:
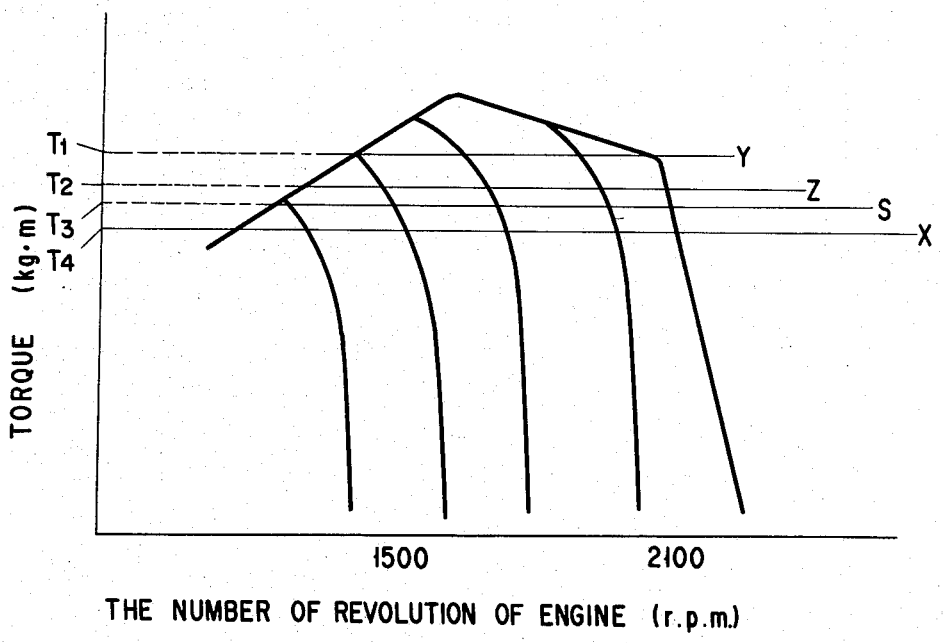
FIG. 8 is a graph showing relation between a torque requirement of the variable displacement and a torque curve of the prime mover.

Concretely, as shown in FIG. 8, the torque requirement in the medium mode position is indicated by Z where relation between the pressure and the per cycle displacement is shown by II' in FIG. 7. The torque requirement in the low mode position is indicated by X where relation between the pressure and the per cycle displacement is shown by III' in FIG. 7. The torque requirement under the connected condition of the redundant circuit 25 is indicated by S. The torque requirement in the ordinary mode position is indicated by Y.

Further, since the discharge pressure of the variable pump is introduced to the variable torque control valve 14 so as to control the pressure at the outlet port 122 by the discharge pressure, the displacement of the variable pump may be controlled in a certain range even if current is supplied to the proportional electromagnetic solenoid 94.

What is claimed is:

1. A fluid operated pump displacement control system comprising a control means connected to respective displacement control devices of variable displacement pumps and adapted to be operated by discharge pressure fluid from a discrete control pump, said control means including neutral control valve means, cut-off valve means and jet sensor means, a variable torque control valve having a proportional electromagnetic solenoid provided in a circuit connecting said control means with said control pump and adapted to operate pressure reduction by a discharge fluid pressure of said variable displacement pumps and a propelling force of said proportional electromagnetic solenoid, electronic means for detecting set output conditions of a prime mover for driving said variable displacement pumps, and means for supplying current to said proportional electromagnetic solenoid according to the difference between a set reference rotational speed in each of said set output conditions and an actual rotational speed of said prime mover.

2. A fluid operating pump displacement control system comprising:

a prime mover means;

a fixed displacement hydraulic control pump driven by said prime mover means;

variable displacement hydraulic pumps driven by said prime mover means for generating a first control signal from a self pressure, said variable displacement hydraulic pumps having displacement control means;

control means connected to said displacement control means of said variable displacement hydraulic pumps, said control means including control mechanisms for controlling said displacement control means, said control mechanisms being controlled by the discharge pressure fluid from said fixed displacement hydraulic control pump through neutral control valves, cut-off valves and jet sensors;

variable torque control valve means for varying said discharge pressure of said fixed displacement hydraulic control pump according to the discharge pressure of said variable displacement hydraulic pumps;

electronic controller means for generating a second arbitrary switchable control signal wherein said arbitrary switchable second control signal is different from said first control signal and said arbitrary switchable second control signal is added to said first control signal, and wherein the variable displacement hydraulic pumps displacements are switched to displacements corresponding to the value of the sum of said arbitrary switchable second control signal and said first control signal.

* * * * *